US006035862A

United States Patent [19]

Di Luca

[11] Patent Number: 6,035,862

[45] Date of Patent: Mar. 14, 2000

[54] CONTAINER FOR TREATING LOCKS OF HAIR WITH ACTIVE SUBSTANCES

[75] Inventor: Giuseppe Di Luca, Arese, Italy

[73] Assignee: Dielle S.R.L., Milan, Italy

[21] Appl. No.: 09/273,155

[22] Filed: Mar. 19, 1999

[30] Foreign Application Priority Data

Mar. 25, 1998 [IT] Italy ..... MI98A0620

[51] Int. Cl.[7] ..... A45D 19/18

[52] U.S. Cl. ..... 132/270

[58] Field of Search ..... 132/270, 208, 132/222; 24/30.5 S, 30.5 L

[56] References Cited

U.S. PATENT DOCUMENTS

| | | | |
|---|---|---|---|
| 1,426,373 | 8/1922 | Frederics | 132/243 |
| 1,710,216 | 4/1929 | James . | |
| 2,038,269 | 4/1936 | Costenoble | 132/243 |
| 2,041,641 | 5/1936 | Grasso . | |
| 2,655,924 | 10/1953 | Petitta . | |
| 2,779,554 | 1/1957 | Kizzek | 24/30.5 L |
| 2,819,721 | 1/1958 | Zakon . | |
| 3,357,070 | 12/1967 | Sloan | 24/30.5 S |
| 3,468,318 | 9/1969 | Cook et al. | 132/270 |
| 3,726,289 | 4/1973 | Thompson | 132/270 |
| 4,155,369 | 5/1979 | Guinan | 132/270 |
| 4,165,754 | 8/1979 | Di Pasqua | 132/270 |
| 4,658,840 | 4/1987 | McCosker | 132/208 |
| 4,914,789 | 4/1990 | Pedersen | 24/30.5 S |
| 5,549,126 | 8/1996 | Green | 132/270 |
| 5,771,906 | 6/1998 | De Benedictis | 132/270 |

FOREIGN PATENT DOCUMENTS

| | | |
|---|---|---|
| 0 624 324 | 11/1994 | European Pat. Off. . |
| 92 14379 | 9/1992 | WIPO . |

*Primary Examiner*—Todd E. Manahan
*Attorney, Agent, or Firm*—Herbert Dubno

[57] ABSTRACT

A container for the treatment of a lock of hair has a base element with a central opening and adapted to be held against the scalp of a user with the lock of hair drawn through that opening. The lock of hair is received in a sheet of flexible material which receives a disk fitted into the base element and having an incision through which the lock passes. An upper portion of the sheet forms a funnel extending through an opening in a lid aligned with incision and the opening in the base element, the funnel receiving the substance.

7 Claims, 2 Drawing Sheets

CONTAINER FOR TREATING LOCKS OF HAIR WITH ACTIVE SUBSTANCES

FIELD OF THE INVENTION

The present invention relates to a container for treating locks of hair with active substances, which comprises a sheet, the central part of which is fixed to means for separating the lock to be treated from the rest of the hair.

BACKGROUND OF THE INVENTION

It is known that, in the art of dyeing and/or bleaching hair in order to form so-called "highlights" providing an aesthetic effect, there is a need to isolate locks of hair of different consistency so as to bring them into contact with the active coloring/bleaching substance.

It is also known that the preselected lock must be isolated from the rest of the hair and from the other locks being treated in order to avoid the undesirable effects of the treatment substance coming into contact with the parts of the hair and/or scalp which must not be treated.

These operations are performed manually by the user who uses special hook-type tools for removing the preselected lock and special containers closed by a lid inside which the dyeing baths and the lock of hair to be treated are placed.

These operations are in practice very long and complicated, requiring, in addition to the working time which makes said operations costly, also a certain expertise on the part of the user.

OBJECTS OF THE INVENTION

It is an object of the invention, therefore, to provide an apparatus for coloring/bleaching locks of hair, which allows rapid and easy removal of the preselected lock and insertion thereof inside the container so as to come into contact with the active substance.

A further object is to provide an apparatus which can contain in a sealed manner the active substance, can be rapidly assembled on and removed from the lock and can be closed around and released from the lock itself at the start or end of the treatment, thus facilitating and speeding up the operation which can therefore also be performed by the user him or herself without the need for specialized personnel.

It is also an object to provide a container for the lock which can be easily washable so that it can be reused in a hygienic condition on different people.

SUMMARY OF THE INVENTION

These technical problems are solved according to the present invention by a container for treating locks of hair with active substances, which comprises a sheet, the central part of which is fixed to means for separating the lock to be treated from the rest of the hair.

BRIEF DESCRIPTION OF THE DRAWING

The above and other objects, features, and advantages will become more readily apparent from the following description, reference being made to the accompanying drawing in which.

Figure 1:
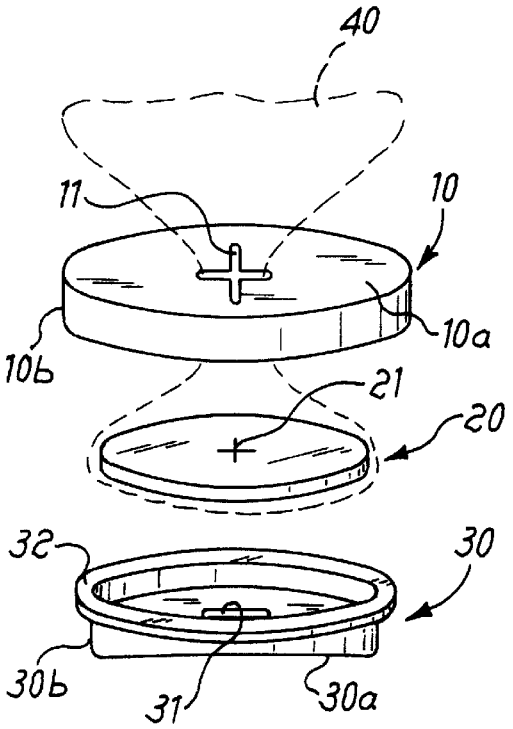
FIG. 1 is an exploded view of the container according to the invention.
Figure 2:
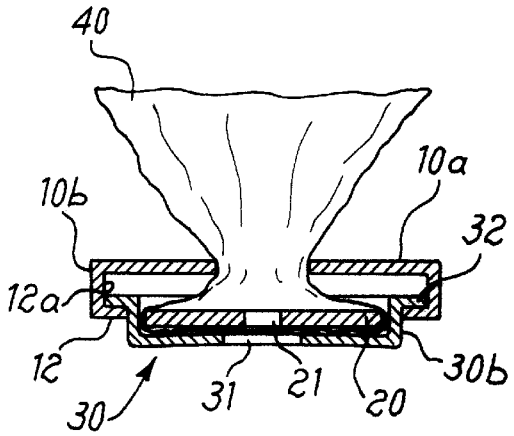
FIG. 2 is a cross-section through the container according to FIG. 1 in the assembled state.

As shown, the container according to the invention is composed basically of an element for separating the lock 60 to be treated, which essentially consists of an upper lid 10, a disk 20 and a base 30 and is joined to a sheet 40 made of suitable deformable material.

In greater detail, the lid 10 has an upper surface 10*a* provided with a substantially four-lobe opening 11 and a side surface 10*b* provided with an internal annular edge 12 which defines a seat 12*a* and is designed to form the element for retaining the base 30 in the axial direction, as will be explained more clearly below.

The base 30 has, in turn, a bottom surface 30*a* provided with an opening 31 and side surface 30*b* provided with an external annular edge 32 designed to engage in the said seat 12*a* of the lid 10 so as to provide a stable relative connection between the two parts.

The bottom surface 30 has, moreover, a shape slightly convex towards the inside.

Figure 4:
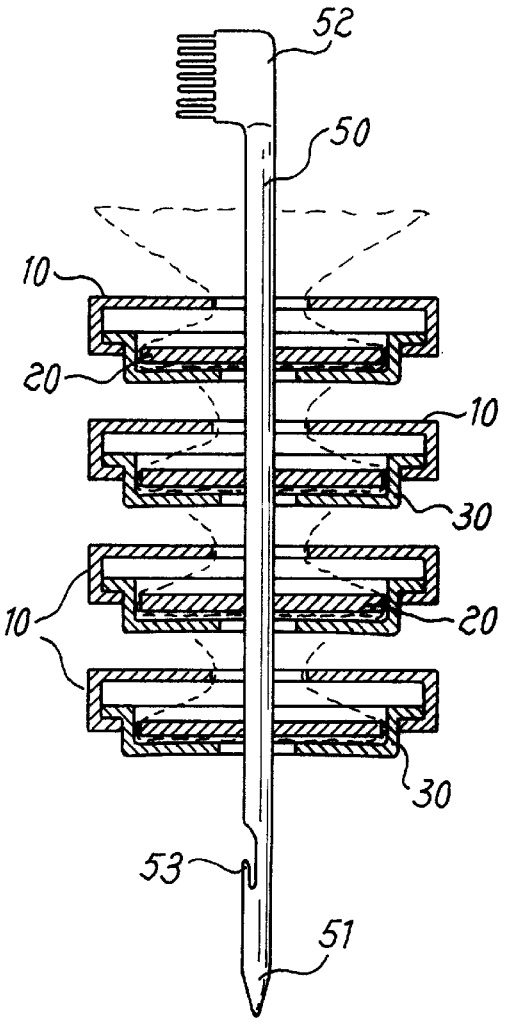
FIG. 4 is a partially sectioned view of an auxiliary tool for grouping together a plurality of containers according to the invention.

The disk 20 is arranged between the base 30 and the lid 10 of the container and has, in turn, a central crossshaped incision 21, the function of which will become obvious below in connection with FIG. 4.

The dyeing container according to the invention is completed by a sheet 40 with a substantially circular shape, the central part of which during use is inserted between lid 10 and base 30 so that the sheet itself is firmly secured to the element for separating the lock, but with an ample surface portion freely projecting therefrom in the form of a funnel so as to allow wrapping thereof around the lock 60 of hair preselected for treatment.

All the various parts which form the container are made with associated dimensions and of suitable materials such as to allow a certain elastic deformation necessary for being able to effect the corresponding joining operations, while at the same time all the parts have precise relative tolerances so as to avoid losses of liquid and/or undesirable movements of the assembly.

The container is assembled for use as follows:

- the disk 20 is placed inside the sheet 40 in the central zone of the latter;
- the central zone of the sheet 40 with the disk 20 is passed through the four-lobe opening 11 in the upper surface of the lid 10;
- once it has been passed through, the free part of the sheet 40 is pulled so that its central part and the disk come into contact with the internal surface of the lid and the respective openings are arranged coaxially; and
- the whole assembly is closed, by force-fitting the base 30 inside the lid 10 so that the said edges 12 and 32 co-operate so as to form a stable connection and also so that the opening 31 is coaxial with the other openings.

Figure 3:
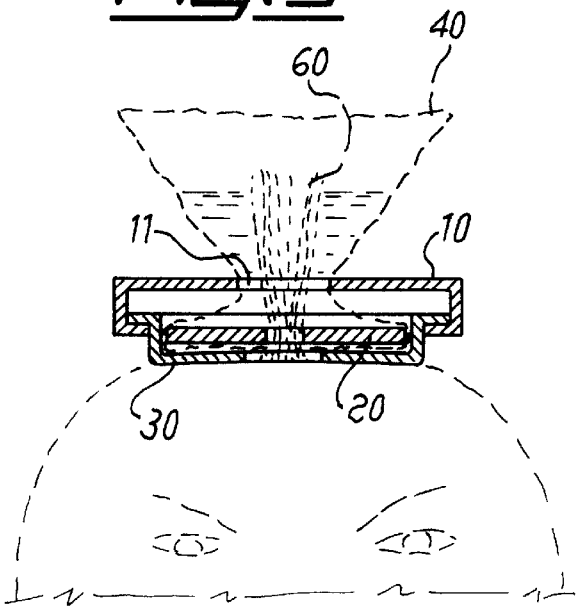
FIG. 3 is a partially sectioned schematic view of the container in the working state.

The container is thus ready for use as follows (FIG. 3):

- the preselected lock 60 of hair to be treated is first taken up with a suitable hook-type tool;
- it is passed through the openings 31,21 and 11 of the base 30, disk 20 and lid 10, respectively, by pulling it inside the funnel formed by the sheet 40;
- the container is pushed towards the scalp so that the concave bottom surface of the base causes a depression which tends to keep the base itself in contact with the skin, allowing the action of the active substance to reach the roots of the hair so as to avoid unaesthetic variations in color in the vicinity of the actual roots;

the active substance for the treatment is poured inside the sheet 40 and the top part of the funnel is closed by suitably folding over the sheet 40; and when the planned treatment time has lapsed, the lock can be simply extracted from the container by pulling the latter outwards.

It must be emphasized that this extraction does not cause spillage of the active substance which on the contrary is retained inside the funnel which is closed at one end by folding over of the sheet 40 and at the other end by the disk 20.

The container according to the invention also envisages (FIG. 4) an auxiliary tool 50 which is substantially cylindrical and which, in a preferred embodiment, has its opposite ends respectively formed as a tip 51 and a comb 52.

At a suitable distance from the tip 51, the tool also has a hook 53 suitable for taking hold of the lock to be treated.

As shown, the tool may function as a loading device onto which a plurality of containers ready for use are coaxially arranged, so that the user is able to select a given lock by means of the hook and pull it inside the first container which at the same time is pushed towards the head where it is left, removing it completely from the tool; this allows the user to repeat the operation rapidly in sequence until the loading device is empty.

In the case of a professional user it is possible to provide a plurality of tools which are already loaded with containers which have been sterilized beforehand, thus reducing further the application times and ensuring the hygienic conditions of the operation.

Figure 5:
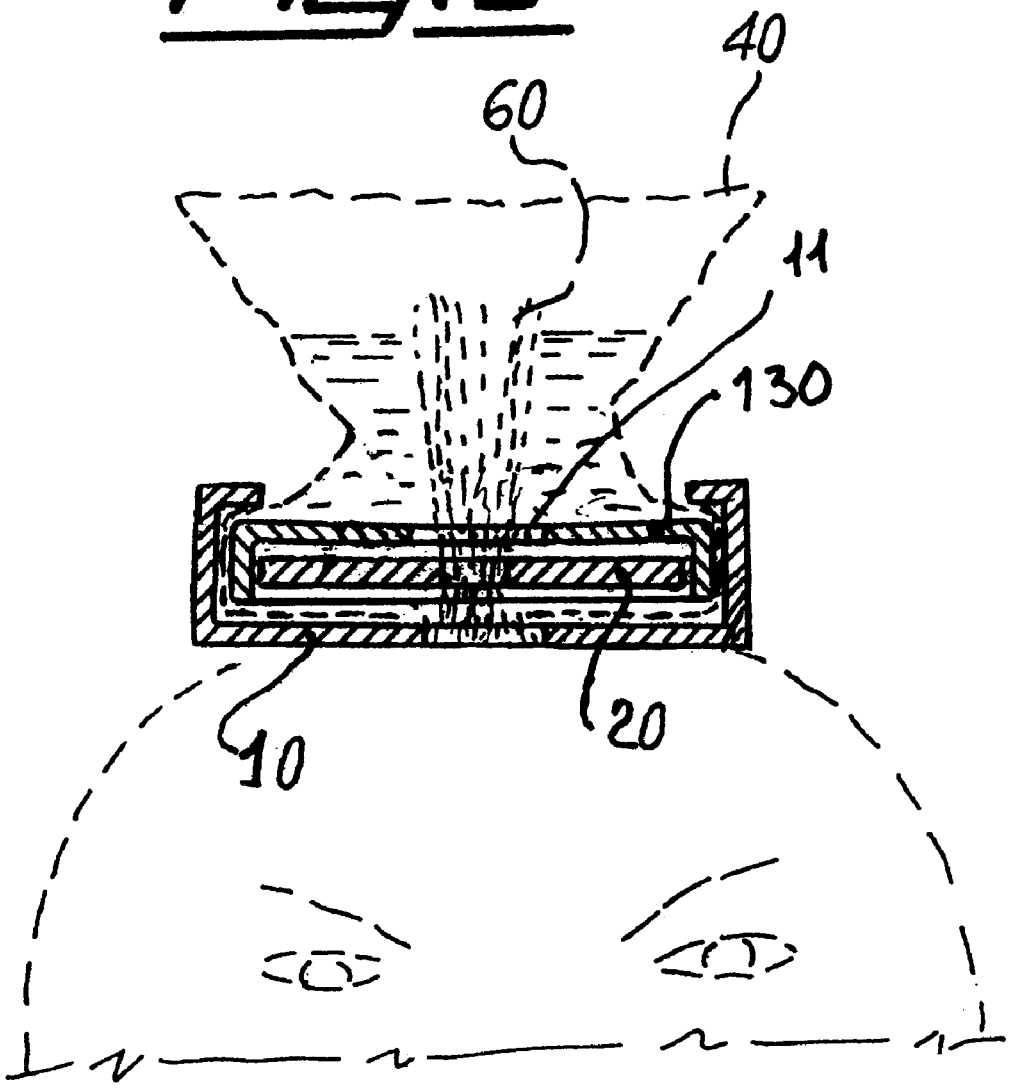
FIG. 5 is a view, similar to that of FIG. 4, of a variation of embodiment of the container according to the invention.

As can be seen from FIG. 5, the container according to the invention may be realised with a base 130 which has a side surface which is cylindrical over its entire axial extension, i.e. does not have the annular edge 32. With this configuration it is possible to modify operation of the container as follows:

the disk 20 is placed inside the base 130, the base 130 is arranged inside the sheet 40 with the front surface 132*a* directed upwards, the container is closed by means of the lid 10 fitted with the open part directed upwards.

In this way the sheet 40 is positioned between the external side surface of the base 130 and internal side surface of the lid 10, thus making assembly of the container much easier and faster since it is no longer necessary to pass the sheet 40 through the opening 11 of the lid 10 itself.

Consequently the container is applied by placing the lid 10 in contact with the skin, the contact surface of said lid being suitably concave.

I claim:

1. A container for treating a lock of hair with a substance, comprising:

a sheet of a flexible material;

a disk received in said sheet having a central incision extending through said disk;

a cup shaped base element receiving said disk, adapted to rest against the scalp of a person whose hair is to be treated and formed with a central opening aligned with said incision and through which a lock of hair can be drawn so that said lock of hair extends through said incision and is surrounded by an upper portion of said sheet, said base element having an upwardly extending annular wall; and a lid fitted on said base element, said lid having a central opening aligned to said incision and with said opening in said base element, whereby said upper portion of said sheet and said lock can extend through said opening in said lid, said lid having an annular wall, one of said walls being formed with a flange for securing said lid to said base element, said upper portion of said sheet being funnel shaped and receiving said substance for treating said lock.

2. The container defined in claim 1 wherein said flange extends outwardly from said wall of said base element and inwardly extending flange of said wall of said lid.

3. The container defined in claim 2 wherein said opening in said lid has substantially a four-lobe shape.

4. The container defined in claim 2 wherein said base element lies outside said sheet and said flange is formed on said wall of said base element and reaches over said lid.

5. A system for treating locks of hair with active substances, comprising:

an elongated tool of substantially cylindrical shape; and a plurality of containers for the treatment of respective locks supported on said tool, each of said containers comprising:

a sheet of a flexible material;

a disk received in said sheet having a central incision extending through said disk;

a cup shaped base element receiving said disk, adapted to rest against the scalp of a person whose hair is to be treated and formed with a central opening aligned with said incision and through which a lock of hair can be drawn so that said lock of hair extends through said incision and is surrounded by an upper portion of said sheet, said base element having an upwardly extending annular wall; and a lid fitted on said base element, said lid having a central opening aligned to said incision and with said opening in said base element, whereby said upper portion of said sheet and said lock can extend through said opening in said lid, said lid having an annular wall, one of said walls being formed with a flange for securing said lid to said base element, said upper portion of said sheet being funnel shaped and receiving said substance for treating said lock.

6. The system defined in claim 5 wherein said tool is formed at one end with a rounded top and a hook for engaging a lock of hair and drawing an engaged lock of hair through a respective one of said containers.

7. The system defined in claim 6 wherein said tool is formed with a comb on an opposite end thereof.

* * * * *